US010723528B2

(12) United States Patent
Knight et al.

(10) Patent No.: US 10,723,528 B2
(45) Date of Patent: Jul. 28, 2020

(54) DISPENSING CLOSURES AND DISPENSERS

(71) Applicant: RIEKE PACKAGING SYSTEMS LIMITED, Leicester (GB)

(72) Inventors: Simon Christopher Knight, Bridgend (GB); John Anthony Faria, Petaluma, CA (US)

(73) Assignee: RIEKE PACKAGING SYSTEMS LIMITED (GB)

( * ) Notice: Subject to any disclaimer, the term of this patent is extended or adjusted under 35 U.S.C. 154(b) by 0 days.

(21) Appl. No.: 16/071,994

(22) PCT Filed: Jan. 20, 2017

(86) PCT No.: PCT/EP2017/051236
§ 371 (c)(1),
(2) Date: Jul. 23, 2018

(87) PCT Pub. No.: WO2017/125577
PCT Pub. Date: Jul. 27, 2017

(65) Prior Publication Data

US 2019/0031405 A1 Jan. 31, 2019

Related U.S. Application Data

(60) Provisional application No. 62/281,921, filed on Jan. 22, 2016.

(51) Int. Cl.
*B65D 47/20* (2006.01)
*B65D 47/32* (2006.01)
*B65D 51/16* (2006.01)

(52) U.S. Cl.
CPC ..... *B65D 47/2056* (2013.01); *B65D 47/2081* (2013.01); *B65D 47/32* (2013.01); *B65D 51/1644* (2013.01)

(58) Field of Classification Search
CPC ..... B65D 47/2056; B65D 51/1644; B65D 47/2081; B65D 47/32
See application file for complete search history.

(56) References Cited

U.S. PATENT DOCUMENTS 4,061,254 A * 12/1977 Nilson ..... B05B 11/0072 222/494
4,444,219 A * 4/1984 Hollenstein ..... B65D 51/1644 137/246

(Continued)

FOREIGN PATENT DOCUMENTS

DE 4119634 A1 * 12/1992 ..... B05B 11/047
DE 4119634 A1 12/1992

OTHER PUBLICATIONS

International Search Report and Written Opinion dated Mar. 3, 2017; International Patent Application No. PCT/EP2017/05123 filed Jan. 20, 2017; ISA/EP.

*Primary Examiner* — Donnell A Long
(74) *Attorney, Agent, or Firm* — McDonald Hopkins LLC

(57) ABSTRACT

A dispensing closure for dispensing liquid, comprising an outer nozzle component (6) defining a nozzle opening (66) and a valve assembly (7) disposed in the closure upstream of the nozzle opening, the valve assembly comprising an outer valve element (3) and a generally rigid intermediate valve seat element (4) disposed inwardly of the outer valve element, the outer valve element comprising an outer valve flap (38) and the intermediate valve element (4) defining an outflow opening (451) bordered by an outer seat region (411, 471), the outer valve flap (38) being movable between a closed position, in which it overlaps the outer seat region of the intermediate valve element to close the outflow opening (451) against inflow therethrough, and an open position, in which it is deflected away from the outer seat region (411, 471) to open the outflow opening for outflow.

13 Claims, 3 Drawing Sheets

(56) References Cited

U.S. PATENT DOCUMENTS

| | | | | |
|---|---|---|---|---|
| 6,581,808 | B2 | 6/2003 | De Laforcade | |
| 7,225,949 | B2 * | 6/2007 | Kubo | B65D 47/06 222/189.08 |
| 2004/0112920 | A1 | 6/2004 | Felten et al. | |
| 2014/0183154 | A1 * | 7/2014 | Essebaggers | B65D 47/32 215/311 |
| 2015/0216723 | A1 | 8/2015 | Yoshimura et al. | |
| 2018/0251273 | A1 * | 9/2018 | Murase | B65D 25/42 |
| 2018/0251274 | A1 * | 9/2018 | Hashimoto | B65D 41/04 |

* cited by examiner

DISPENSING CLOSURES AND DISPENSERS

CROSS-REFERENCE TO RELATED APPLICATION

This application is a 35 U.S.C. 371 national stage filing of PCT Application No. PCT/EP2017/051236 filed on Jan. 20, 2017, entitled "DISPENSING CLOSURES AND DISPENSERS," which claims priority to U.S. Provisional Patent Application No. 62/281,921, filed on Jan. 22, 2016, each of which are incorporated herein in their entirety by reference.

FIELD OF THE INVENTION

This invention relates to dispensing closures for dispensing liquid products from containers, and to dispensers comprising a closure mounted on or comprised in a container for liquid product. The proposals relate particularly but not exclusively to squeeze dispensers, in which the container is resiliently squeezable to force liquid product out through an outlet path defined through the closure, and subsequently recovers drawing compensation air back into the container. The present proposals are also envisaged to be useful for drinks dispensers in which the container holds a drink and a user may squeeze liquid into their mouth or suck on the closure.

BACKGROUND

The invention is particularly concerned with valved closures, in which the closure includes a valve device which opens the outflow path for dispensing and closes it when dispensing pressure is relieved.

Crossed-slit silicone valves are widely used for this purpose: an inwardly convex silicone rubber dome with crossed slits is mounted in the outlet opening of the closure. Under dispensing pressure it inverts (bulges outwardly) and the slits open up as a flow opening. When pressure is relieved the rubber dome flips rapidly back in to its original form, closing the slits. Flow is immediately cut off and dripping prevented, while on recovery compensation air can enter and suck-back of residual product at the outlet may also be achieved. Another known drink bottle valve has a slit rubber outlet piece in which the slit gapes open when the user bites on the tube. However, while these slit rubber valves are effective, the rubber is expensive and neither recyclable nor degradable.

Our aim herein is to provide new and useful types of valved dispensing closure, and corresponding dispensers, especially with a view to providing a closure that requires neither special elastomer materials nor auxiliary springs and the like, and which in preferred embodiments is suitable for a drinks dispenser. A corresponding drink dispenser comprising the closure in combination with drink container is an aspect of our proposals.

SUMMARY

One object of our proposals is a dispensing closure including a valve assembly for closing off the liquid source, e.g. container interior, when not dispensing, and which can be made without the use of rubber materials or discrete springs. In particular, it is desirably to be made from injection-molded components of thermoplastics such as polypropylene.

Another object of our proposals is to provide a dispensing closure with a two-way valve operation, so as to allow flow in either direction under appropriate pressure difference.

Another object of our proposals is to provide a dispensing closure for a drink dispenser or drink bottle which readily provides a substantial outflow opening under moderate pressure difference, and a corresponding drink dispenser.

One aspect of our proposals is a dispensing closure comprising an outer nozzle component, such as a nozzle cap, and a valve assembly comprising a first, outer valve element including a mobile outer valve flap, and a second valve element disposed inwardly adjacent the first which defines a flow opening for outflow, the flow opening being bordered by a seat region. The valve flap has a closed position in which it overlaps the seat region of the second valve element to close the outflow opening, and an open position in which it is deflected to open the outflow opening. This outwardly-deflectable valve flap operates as a check valve to prevent inflow through the outflow opening. Preferably the valve assembly comprises an inner valve element having a mobile inner valve flap with a closed position in which it engages around a valve seat region bordering an inflow opening in a valve element—which may be the first valve element or second valve element mentioned above—and an open position in which it is deflected to open the inflow opening. The or each valve element lying outside the inner valve element defines or provides flow clearance for inflow through the inflow opening in the closed condition of the outer valve flap. Conversely, the or each valve element lying inside the outer valve element defines or provides flow clearance for outflow of liquid through the outflow opening in the closed condition of the inner valve flap.

Preferably the outer nozzle or nozzle cap component comprises a fixed nozzle formation defined an outlet opening of the closure. The mentioned valve elements may be mounted inside this nozzle cap or outer nozzle cap component. The nozzle formation desirably has a tapering exterior surface, and may in particular be a drinking nozzle. In preferred embodiments the nozzle cap constitutes a closure for a container such as a bottle, e.g. a squeezable bottle such as plastic drinks bottle or drinks container. This may be of a re-usable type or a single-use type. However an alternative is possible, such as on the end of a drinking tube connected to a drink container, in a drinking device for athletes.

According to a further aspect of our proposals a dispensing closure, through which in use fluid product is dispensed in an outward direction through an outlet path defined through the dispensing closure to an external nozzle thereof having an outlet opening, includes a valve assembly comprising inner and outer valve elements and an intermediate element disposed between them. The intermediate element defines an outflow opening and an inflow opening. The intermediate element provides a first valve seat region bordering the outflow opening and a second valve seat region bordering the inflow opening. The outer valve element has a deflectable blocking portion engageable with the first valve seat region in a closed position of the outer valve element, and the inner valve element has a blocking portion engageable with the second valve seat region of the intermediate element in a closed position thereof. Preferably the intermediate element has oppositely-directed inner and outer faces, and the inner and outer blocking elements are deflectable from their closed positions away from the respective faces to open positions in which they are spaced from their respective valve seat regions to allow liquid flow through the respective inflow or outflow opening.

The closure defines flow clearance past the blocking portions and other structure of the inner and outer valve elements, so that fluid can flow through the closure when a relevant valve is open.

In a closed position of the valve assembly, typically corresponding to a passive condition without excess pressure from outside or inside, each of the inner and outer blocking portions engages with its respective valve seat region closing off both the inflow and outflow openings. Desirably in this closed condition a resilient mounting or resilient nature of one or both of the inner and outer valve elements, arising preferably from pre-tensioning of the structures thereof (e.g. by molding them with shapes different from their eventual shapes in the assembly) urges the respective blocking portion against its seal region positively to hold the respective flow opening closed. Thus, the closure can protect an interior region such as container contents from contamination, and prevent inadvertent escape or splashing out of liquid.

Under positive fluid pressure from the inner or interior side—such as on squeezing a container containing the product—the valve is operable in an outflow condition in which the excess pressure, acting on the blocking portion of the outer valve element via the outflow opening, deflects that blocking portion to the open position, opening up the outlet path. Product then flows out through the mentioned flow clearance via the outflow opening, for dispensing via the nozzle outlet opening.

Finally the valve is operable in a recovery or venting mode in which an excess of pressure exists outside the closure, such when a squeezed resilient container recovers its volume after dispensing and reduces the internal container pressure. Under these conditions the pressure difference acts on the blocking portion of the inner valve element, via the inflow opening, deflecting the blocking portion to the open position and away from its valve seat region, for inward flow via the inflow opening. In the typical disposition, this may be a vent or flow of compensation air entering the container. If residual liquid product is present at the outer side of the valve assembly, this product may also be sucked back in through the closure.

Desirably the closure has an outer body portion adapted for fixed mounting on or to a container or conduit, e.g. onto a container neck, or onto an outlet conduit connected to a container or pump. This body portion is desirably formed integrally, such as being molded in one piece, with the outer nozzle.

Desirably the intermediate element defining the mentioned flow openings and valve seat regions is substantially fixed in the closure relative to the body thereof, e.g. by virtue of its structure being stiffer than those of the outer and inner valve elements so that in the outflow and inflow modes the blocking portions of the valves move while the seating regions hold their position. This feature has the advantage that the characteristics of the inner and outer valve elements (such as the forces needed to open them, the distance of movement of their blocking portions and the resulting flow opening sizes) can be varied independently to produce a desired performance. Each valve can operate independently. Preferably the intermediate element is a one-piece entity such as a single molded part.

One or both blocking portions are desirably in the form of a flap, preferably a flap suspended on one or more support limbs rather than a hinged (swinging) flap although the latter is possible.

By means of the present proposals, a valved dispenser pack can be made easily from the container, nozzle and only three components for the valve assembly, all of which can be fully recyclable if made from suitable material such as polypropylene. Testing has confirmed that bi-directional valve action for dispensing and venting/suck-back is achievable without the need for any elastomer component or separate spring.

Preferably the elements of the valve assembly are centred on an axis extending in the outward direction of the closure, e.g. the axis of the nozzle and/or of a tube or container neck. In a preferred arrangement, the inflow opening of the intermediate element is at a central part of the intermediate element, and the outflow opening is at a peripheral region of the intermediate element, e.g. surrounding the inflow opening. For example the inflow opening may be a single central opening encircled by an annular seat surround, and the outflow opening is provided as one or more flow windows surrounding the annular seat surround. This maximises flow area available for outflow relative to that for inflow, which is the usual preference. The annular seat surround may be connected to a peripheral annular portion, such as a mounting portion, of the intermediate element through a support structure, consisting e.g. of one or more support limbs or spokes. As mentioned it is preferred that this support structure is relatively stiff; for this purpose the one or more support limbs or spokes may be made of thick section, or more preferably with a channel section e.g. H- or I-section, to give rigidity. Desirably the outer blocking portion has a central flow clearance, and the annular edge of this may seal against an outer side of the annular seat surround of the intermediate element, which presents a generally outwardly-directed sealing region. Correspondingly, the blocking portion of the inner valve element may then be positioned and shaped to block the central second flow opening of the intermediate element, which may then present a generally inwardly-directed sealing region.

The blocking portion of the inner valve element is mounted in alignment with the inflow opening of the intermediate element by support structure comprised in the inner valve element, desirably including one or more flexible limbs. Preferably the support structure of the inner valve element is mounted to (or in) the outer valve element or the intermediate element, so that the closure is an integrated device which may in turn be a push, snap or screw fit in the outer nozzle or cap component. Desirably the inner valve element is a push-fit into or onto the outer valve element and/or into or onto the intermediate element. The inner valve element may have an annular mounting formation, such as an outwardly-directed edge or retaining ring, which may engage in a corresponding inwardly-directed retaining formation of the outer element or intermediate element.

The inner valve element is desirably a generally circular component.

The blocking portion of the inner valve element may be supported generally centrally in that element, and may be in the form of a disk or plate, or a blocking formation on a disk or plate. Desirably the inner blocking portion has an outwardly-directed sealing surface, such as an annular surface, shaped and dimensioned to make a seal closing the inflow opening, such as a seal against an annular seat surround portion of the intermediate element defining the inflow opening. The blocking portion may enter or plug into this. Thus, the blocking portion may consist or comprise a circular region, which may be an outward eminence, on a central plate or disk of the inner valve element. This disk or plate may lie in a radial plane of the closure or valve assembly.

The blocking portion of the inner valve element is desirably supported relative to an outer fixed part of the support structure via one, two or more flexible limbs so that it is inwardly deflectable as described above to open the second flow opening. The thinner and longer and hence more readily flexible these limbs, the smaller the force required to open the valve for inflow, e.g. for air venting or product suck-back. So, the number and structure of these limbs can be designed to take account of suction forces expected from a product container and the viscosity of the product which may need to be sucked back.

One possibility is to support the blocking portion from one (radial) side and not the other, e.g. by a single limb. Deflection of the blocking portion by flexing of this limb is with a tilting action, opening up a relatively large opening on the side opposite the limb e.g. for suck-back of more viscous products. Conversely, supporting the blocking portion from all around, such as by two or more circumferentially-distributed limbs, restricts the maximum dimension of the vent/suck-back opening but improves the quality of the resting seal by inhibiting tilting. For a drink dispenser where viscosity is low generally the latter is preferred.

Returning to the intermediate element: as mentioned a structure with a peripheral outflow opening and a central inflow opening is preferred. The outflow opening may be sub-divided by support structures for an annular seat surround of the central inflow opening. These support structures may in turn be mounted on a peripheral mounting portion, desirably an annular or part-annular mounting portion, through which the element is connected to the rest of the valve assembly or closure. Desirably this mounting portion fits, e.g. with a snap connection, into or onto the first/outer valve element, or another component of the closure, and/or with the second/inner valve element. Desirably all three of the outer, inner and intermediate elements can click or snap together to form an integrated assembly which can hold itself together even before an outer nozzle component, container or conduit is connected to it. Preferably the intermediate element is generally annular, and generally flat. An outer annulus, which may constitute or incorporate the mentioned mounting formation, can be connected to an inner annular surround as mentioned by one, two, three or more connecting limbs or spokes.

We particularly prefer that the inner element, outer element and preferably also the intermediate element are non-elastomeric. They may be made from thermoplastic materials, such as polypropylene which is both economical and recyclable. They may be three separate parts to be connected together, although options exist for forming them integrally, such as by molding in an extended position and then folding to oppose them. In a preferred embodiment they are concentric annular components disposed transverse to a central axis which is also the outlet axis and/or the direction of a container neck or conduit axis.

BRIEF DESCRIPTION OF THE DRAWINGS

An embodiment of the invention is now described with reference to the accompanying drawings, in which.

DESCRIPTION OF THE SELECTED EMBODIMENTS

Figure 1:
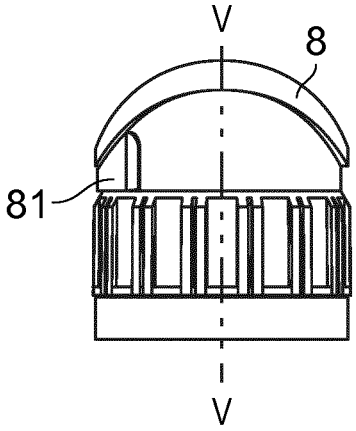
FIGS. 1 and 2 are mutually orthogonal side views of a closure embodying the invention, with a lid in place.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in detail, although it will be apparent to those skilled in the relevant art that some features that are not relevant to the present invention may not be shown for the sake of clarity.

Figure 2:
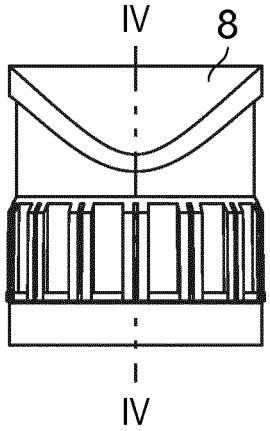
Figure 3:
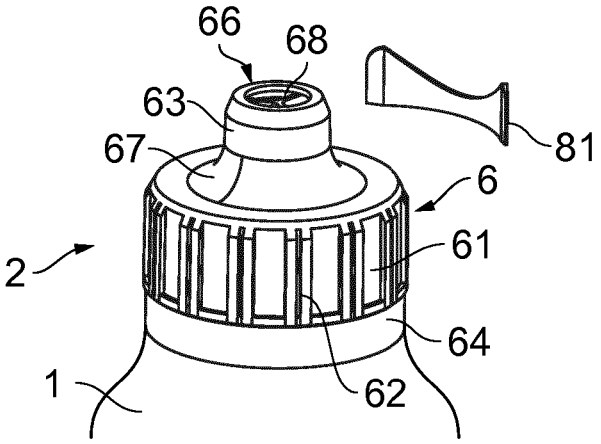
FIG. 3 is a perspective view of the closure, on a container and with the lid removed.
Figure 4:
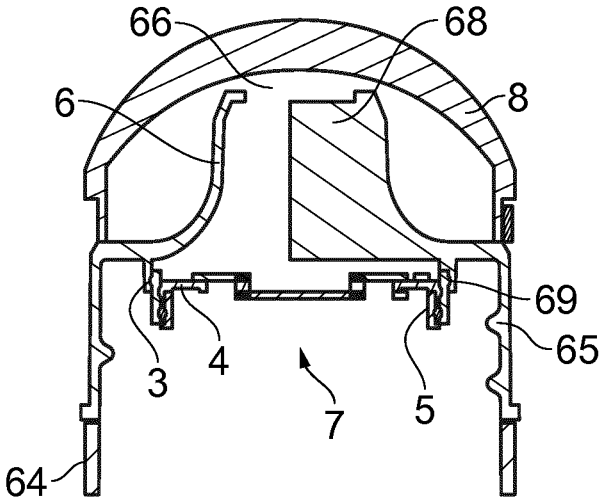
FIG. 4 is a cross-section through the closure at V-V of FIG. 1.
Figure 5:
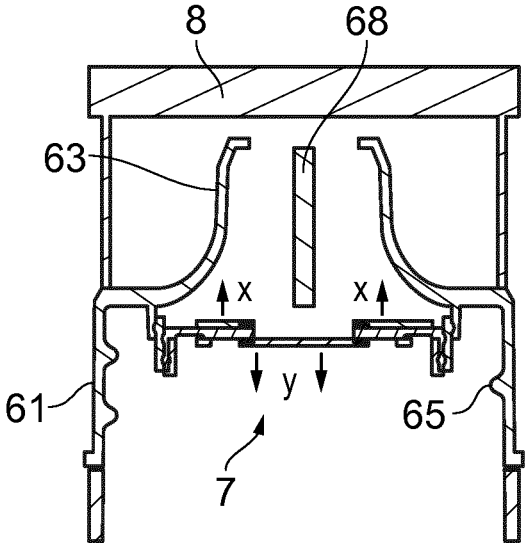
FIG. 5 is a cross-section through the closure at IV-IV of FIG. 2.
Figure 6:
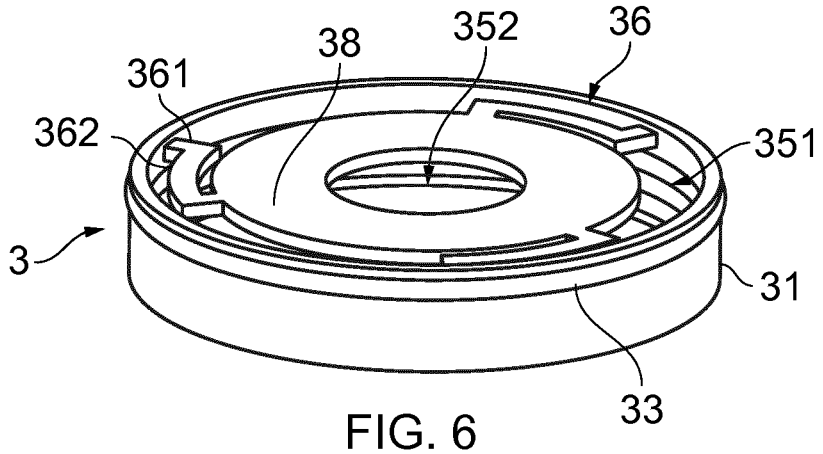
FIG. 6 is a perspective view of an outer valve element of the closure.
Figure 7:
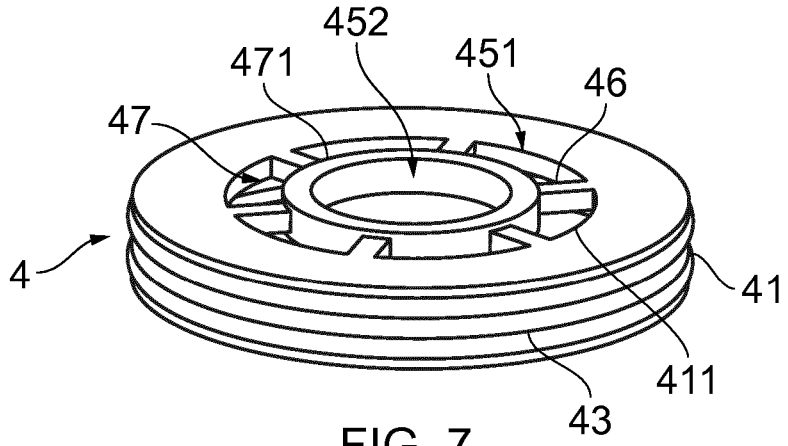
FIG. 7 is a perspective view of an intermediate seat element of the closure.
Figure 8:
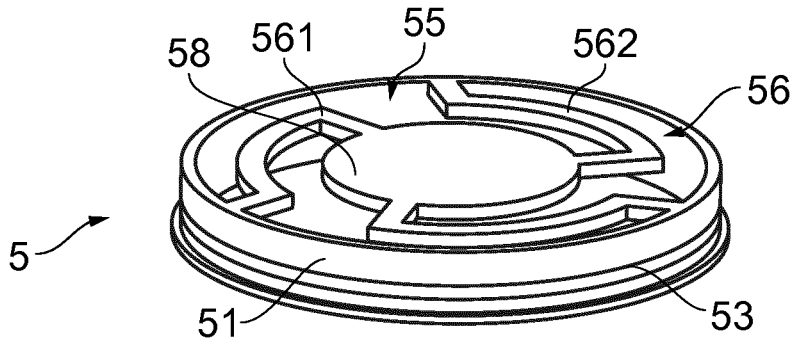
FIG. 8 is a perspective view of an inner valve element of the closure.

With reference to FIGS. 1 to 3, a dispensing closure 2 comprises a cap element 6 with a nozzle 63 having a nozzle opening 66 from which a user can drink when the closure 2 is mounted on a drink container 1. With reference also to FIGS. 4 and 5, the cap 6 is connected to a neck of the container (not shown) by a conventional skirt 61 having an internal thread 65 for engagement with a thread of the container neck (not shown). The cap skirt 61 has an exterior grip formation 62 and connects to a tamper-evident strip 64 around its lower edge to indicate, in a known way, if the cap 6 has been removed from the container 1 as sold. The nozzle 63 projects up axially from the top centre of the cap via a smoothly tapered transition 67; again this is a known form to provide a user-friendly nozzle which can be put into the mouth safely and comfortably. It is well known that the users of squeezable drinks bottles sometimes squirt liquid into their mouths by squeezing the bottle, and at other times prefer to tip the bottle and suck on the nozzle.

The nozzle interior has a set of vanes 68 which are conventional and not an essential feature herein; other forms of nozzle may be used. The drawings also show a removable lid 8 with a tamper-evident pull-strip 81; again this is not intrinsic to the inventive proposal and other forms of lid, cap, cover or plug may be used, or none at all.

The present drink bottle differs from a conventional drink bottle particularly in that the closure includes a valve assembly 7 to control fluid flow between the interior of the container 1 and the outlet 66. By this special valve mechanism, communication between the nozzle opening 66 and container interior is normally closed, opens readily for dispensing of liquid at a flow rate adequate for a drink bottle, closes promptly when dispensing ceases e.g. when squeeze pressure on a container is relaxed, but also allows for venting of compensation air into the container and for residual liquid outside the valve assembly 7 to be drawn back into the container.

The valve assembly 7 is a generally circular assembly comprising an outer valve element 3, an intermediate valve seat element 4 and an inner valve element 5. With the container neck pointed up (as shown) "outer" and "inner" correspond to "upper" and "lower" respectively, and this terminology is sometimes used for clarity, but it should be understood that the closure will operate in any orientation.

The mentioned elements of the valve assembly are molded from thermoplastic material, preferably polypropylene. Each of the outer valve element, inner valve element and intermediate valve seat element is a one-piece molding. In this embodiment the outer valve element 3 comprises a peripheral mounting ring 31 with a radially-outwardly directed snap formation 33, which snaps upwardly into a corresponding downwardly-directed securing skirt 69 beneath the top of the closure cap; see FIGS. 4, 5 and 9. The intermediate valve seat element 4 in turn has a peripheral outer mounting ring 41 with exterior snap formations 43, and the inner valve element 5 has an outer mounting ring 51 with exterior snap formations 53. The intermediate and inner elements 4,5 nest up successively inside the outer element 3, with engagement of the snap formations with one another as shown, to hold the valve assembly 7 together in all directions.

The intermediate element 4 is a generally rigid structure, comprising an inner seat annulus 471 held coaxially inside the outer mounting ring 41 by a support structure consisting of a plurality of spaced limbs, here radial spokes 46. Both spokes and inner seat annulus are formed with depth, and a channel form of the spokes, so that they will not flex in or out. A central flow opening 452 (inflow opening) is defined through the inner annulus 47, and a peripheral flow opening 451 (outflow opening) is defined, in the form of a set of segments or windows—between the inner annulus and the outer ring, sub-divided by the spokes 46. In operation of the device, as will be explained below, liquid flows out of the closure through the peripheral flow opening 451. Recovery air and any sucked-back product flow in through the central opening 452.

The outer valve element 3 comprises a thin annular valve flap 38, with a central opening 352, supported coaxially inside the mounting ring 31 by flexible limbs 36. The limbs 36 allow for relatively free axial deflection of the flap 38 upwardly/outwardly relative to the mounting ring 31. Peripheral flow clearance 351 (outflow clearance) is defined between the flap 38 and the mounting ring 31, divided but not significantly reduced by the flexible limbs 36. The limbs are formed much longer than the radial distance to be bridged, with elongate circumferential elements 362 between their radial elements 361, increasing the lift distance of the flap 38 under modest pressure difference to give a large flow area between the lifted flap 38, the mounting ring 31 and the intermediate seat element 4 below.

In the assembled valve the outer valve flap 38 overlies and covers the peripheral flow opening 451 of the intermediate element 4, and its inner and outer annular peripheries overlap the upwardly-directed surfaces of the intermediate element 4. The corresponding regions of overlap, including an inwardly-projecting flange of the mounting ring 41, constitute valve seat regions 411,471 for the outer valve flap 38. In the rest condition shown, the valve flap 38 therefore fully closes the peripheral flow opening 451. Optionally the outer valve element as molded has the flap slightly below (inwardly of) the illustrated level, so that in the assembly it is slightly urged against the valve seat regions 471,411 to make a positive seal. The central opening 352 of the valve flap is as large as or larger than the central flow opening 452 of the intermediate element 4, so the outer valve does not control this opening.

The inner valve element 5 also comprises a valve flap 58 coaxially supported in the centre of the mounting ring 51 by a set of flexible limbs 56, and again these limbs are formed to allow ready deformation with a substantial axial reach, by virtue of circumferential segments 562 between radial segments 561. Peripheral flow clearance 55 is defined around the valve flap 55, subdivided but not significantly obstructed by the thin limbs 56. The inner valve flap 58 is a closed disk whose diameter is about the same as the inner annulus 47 of the intermediate element 4; that annulus 47 has a downwardly (inwardly)-directed flat surface 472 (see FIG. 9) and in the rest position of the closure, as shown, the edge of the inner valve flap 58 fits closely up against this downward surface 472 which therefore constitutes a valve seat for the inner valve flap 58, to close the central flow opening 452. Radially outwardly of the inner valve flap 58 the peripheral flow clearance 55 of the inner element 5 underlies the peripheral flow clearance 451 of the intermediate element 4, so that there is full fluid communication through this peripheral region of the closure.

As with the outer valve element, it is optional and preferred that the inner valve flap 58 is pre-tensioned for a positive seal, by making it with an as-molded shape in which the flap 58 projects slightly above the mounting ring 51, so that the limbs must be slightly bent against their resilience when the valve is assembled.

Figure 9:
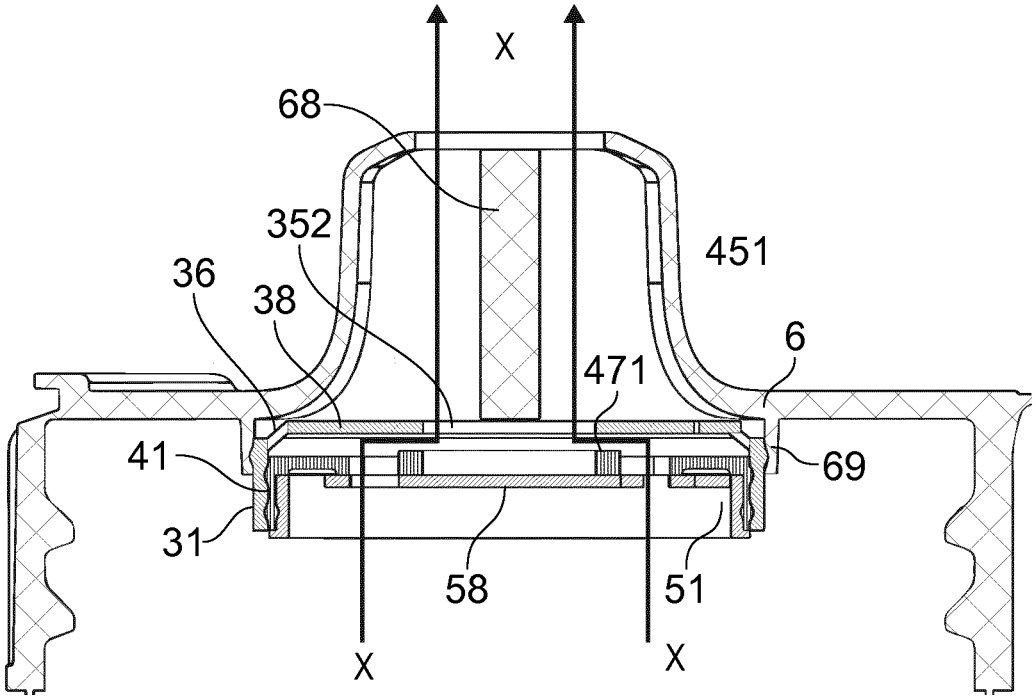
FIG. 9 is an enlarged cross-section view of the valve assembly of the closure in an outflow condition.

Operation is as follows. When the container is squeezed, or when a user sucks on the nozzle 63, a pressure difference arises across the valve assembly 7. This lifts the outer valve flap 38 off its seats 471,411, with flexion of its mounting limbs 36, as indicated by arrows "x" in FIG. 5. Because the limbs 36 are free to flex through a long distance under light pressure difference, a large outflow opening is opened up between openings 451,352 for dispensing flow of liquid. FIG. 9 shows the path "X" of liquid flow and the outwardly-deflected position of the outer flap 38.

Figure 10:
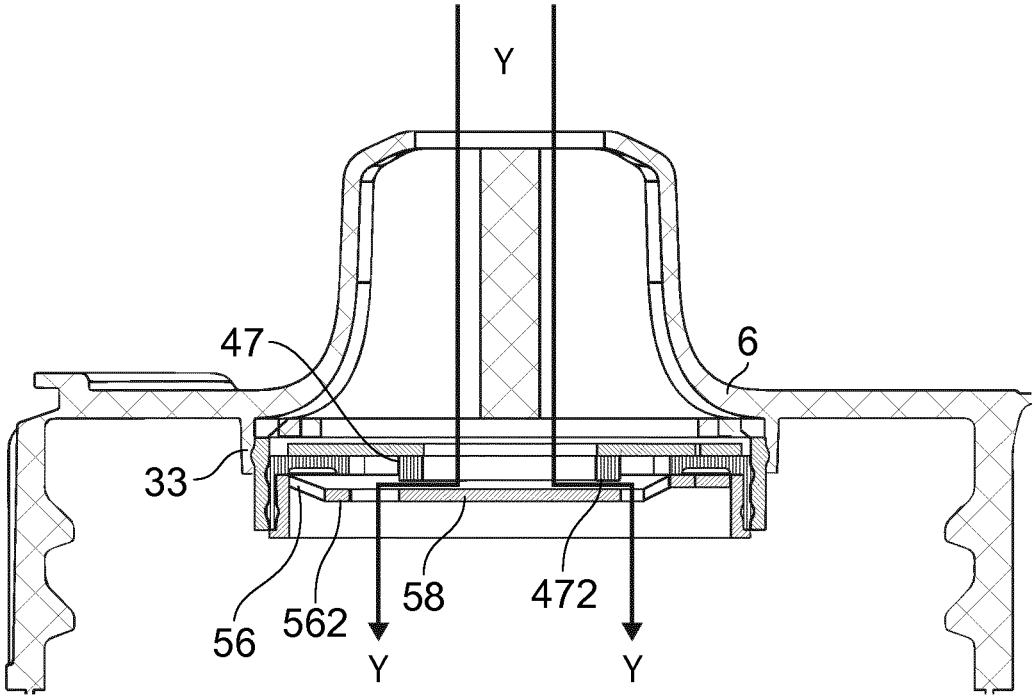
FIG. 10 is a similar cross-section showing an inflow or recovery/suck-back condition.

When the user stops squeezing the container, or stops sucking on the nozzle, the container re-expands resiliently creating a negative pressure difference across the valve assembly 7. This promptly draws the outer valve flap 38 in to close against its seats 411,471, stopping flow through the peripheral flow opening 451. Rather, the negative pressure difference deflects the inner valve flap 58 in and away from its valve seat 472 (arrows "y" in FIG. 5), opening up the central inflow opening 452 of the intermediate element 4 for inflow of compensation air and any residual liquid in the nozzle adjacent the valve 7. The small force and large reach provided by the thin support limbs 56 of the inner valve provide for reliable venting and easy suck-back. FIG. 10 shows the path "Y" of fluid flow (recovery air and/or liquid suck-back) and the inwardly-deflected position of the inner flap 58.

Once the pressures equalise the inner valve flap 58 returns to close the central opening 452 and the valve assembly is fully closed as before.

This action provides immediate closure of the outflow channel when outward pressure differential drops or ceases, preventing dripping and splashing. The closed rest condition of the valve prevents inadvertent contamination of the contents through the nozzle.

The valve assembly 7 is injection-molded from polypropylene, which is a very cheap and recyclable material. No elastomer or separate spring is required to operate the valve effectively. The suggested structure of the valve components, which fit together, makes the closure susceptible of easily automated assembly. The outer cap can be molded from conventional material and in a conventional form so that users can have a familiar nozzle structure.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A dispensing closure comprising an outer nozzle and a valve assembly having a first valve element formed with a peripheral mounting ring, a second valve element and an intermediate valve element between the first and second valve elements so that the intermediate and second valve elements are annularly nested within the peripheral mounting ring, and wherein: (i) the intermediate valve element at least partly defines an outflow opening and an inflow opening for flow through the dispensing closure; (ii) the first valve element comprises a first deflectable blocking portion operable to prevent liquid inflow through the outflow opening in a closed condition thereof; (iii) the second valve element comprises a second deflectable blocking portion operable to prevent liquid outflow through the inflow opening in a closed condition thereof; and (iv) the first deflectable blocking portion is a flat annular flap with a central opening and the second deflectable blocking portion is a flat disk.

2. A dispensing closure of claim 1 wherein the intermediate valve element provides a first valve seat region bordering the outflow opening and a second valve seat region bordering the inflow opening, the first and second valve seat regions being engaged respectively by the first and second deflectable blocking portions in their closed positions.

3. A dispensing closure of claim 1 wherein the intermediate element has oppositely-directed first and second faces respectively engaging the first and second valve elements.

4. A dispensing closure of claim 1 wherein the inflow opening of the intermediate element is at a central part of the intermediate element and the outflow opening is at a peripheral region of the intermediate element.

5. A dispensing closure of claim 4 wherein the inflow opening is encircled by an annular seat surround connected by a support structure to a peripheral mounting portion of the intermediate element, and the outflow opening is provided as one or more flow windows surrounding the annular seat surround, through said support structure.

6. A dispensing closure of claim 1 wherein the first valve element comprises a peripheral mounting portion and the deflectable blocking portion thereof is connected to the peripheral mounting portion by one or a plurality of flexible support limbs.

7. A dispensing closure of claim 1 wherien the second valve element comprises a peripheral mounting portion and the deflectable blocking portion thereof is connected to the peripheral mounting portion by one or a plurality of flexible support limbs.

8. A dispensing closure of claim 1 wherein all of said valve elements are moulded thermoplastic components.

9. A dispensing closure of claim 1 wherein all of said valve elements are of polypropylene.

10. A dispensing closure of claim 1 wherein all of said valve elements are fitted inside an outer nozzle component.

11. A dispensing closure of claim 10 wherein the outer nozzle component comprises a cap integrally formed with a nozzle.

12. A dispenser comprising the dispensing closure of claim 1 connected to a container for a liquid to be dispensed and wherein the dispensing closure includes a cap element having a tamper evident strip affixed thereto, said cap element snap-fittingly receiving the mounting ring.

13. A dispenser of claim 12 in which the container is a resiliently squeezable container.

* * * * *